US005787330A

United States Patent [19]

Funato

[11] Patent Number: 5,787,330

[45] Date of Patent: Jul. 28, 1998

[54] IMAGE FORMING APPARATUS HAVING SHEET CURVATURE CORRECTING DEVICE

[75] Inventor: Hitoshi Funato, Ebina, Japan

[73] Assignee: Fuji Xerox Co., Ltd., Tokyo, Japan

[21] Appl. No.: 725,322

[22] Filed: Oct. 2, 1996

[30] Foreign Application Priority Data

Oct. 4, 1995 [JP] Japan ..... 7-258007

[51] Int. Cl.[6] ..... G03G 15/00

[52] U.S. Cl. ..... 399/390; 271/188; 399/406

[58] Field of Search ..... 399/388, 389, 399/390, 406; 162/197, 270, 271; 271/188, 209

[56] References Cited

U.S. PATENT DOCUMENTS

| | | | |
|---|---|---|---|
| 5,113,226 | 5/1992 | Tadokoro et al. | 399/390 |
| 5,442,429 | 8/1995 | Bartholmae et al. | 399/406 |
| 5,565,970 | 10/1996 | Suda | 399/406 |
| 5,602,636 | 2/1997 | Matsuzawa | 399/388 |

FOREIGN PATENT DOCUMENTS 5-27608 2/1993 Japan .

*Primary Examiner*—William J. Royer
*Attorney, Agent, or Firm*—Oliff & Berridge, PLC

[57] ABSTRACT

A sheet S is supported by a movable cylindrical transfer drum 12 and a toner image is transferred from a photosensitive drum 9 onto the sheet S in this state. The sheet S is curved by curl rolls 29, 30 of a conveyer unit 20 so that it is curved outward in harmony with the direction of the transfer drum 12 and that its curvature radius is smaller than that of the transfer drum 12. Then the sheet S is conveyed toward the transfer drum 12. A guide plate 40 is placed between the curl rolls 29, 30 and the transfer drum 12 and the leading end portion of the sheet S conveyed from the curl rolls 29, 30 abuts and slides on the guide face 42 of the guide plate 40. Thus, a moment is given to the following portion of the sheet S held between the curl rolls 29, 30 and the curvature radius of the following portion thereof is corrected so that the curvature radius of the following portion thereof may be increased.

10 Claims, 7 Drawing Sheets

IMAGE FORMING APPARATUS HAVING SHEET CURVATURE CORRECTING DEVICE

BACKGROUND OF THE INVENTION

1. Field of the Invention

The present invention relates to image forming apparatus such as copying machines, printers, facsimiles and the like, and more particularly to an image forming apparatus for forming an image on a sheet by making a movable sheet support means, for example, a drum support the sheet, which sheet support means has an arcuate portion curving outward.

2. Description of the Related Art

A certain image forming apparatus is adapted so that an image is formed on a sheet which is supported on the surface of a cylindrical support drum. In the case of an image forming apparatus utilizing electrophotography, an image carrier means such as a photosensitive drum, on which surface a toner image is formed, and a transfer drum, onto which surface a sheet is made to stick, are set adjacent to each other and when the sheet on the transfer drum is situated opposite to the image carrier, the toner image is transferred from the image carrier to the sheet.

When the sheet is conveyed to the drum, the movement of the leading edge portion of the sheet, which is normally rectangular, is stopped once by means of registration rolls brought to a standstill so as to set the leading edge portion thereof uniformly perpendicular to the direction in which the sheet is conveyed. Further, the sheet is led to reach the drum by, for example, rotating the registration rolls in harmony with timing at which an image is then formed.

In order to set the leading edge portion of the sheet uniformly perpendicular to the direction in which the sheet is conveyed, however, it is necessary not only stopping the leading edge portion of the sheet once but also keeping the following portion of the sheet moving toward the registration rolls. Thus the following portion of the sheet is inevitably caused to curve. Therefore, highly rigid paper, for example, thick paper tends to retain the curvature in the form of plastic deformation.

In a case where an image is formed on both sides of a sheet, moreover, the sheet is supported by a support drum before being passed through a fixing device once when an image is formed on one side of the sheet. Therefore, the sheet has often been largely curved because of plastic deformation before another image is formed on the other side of the sheet.

When the sheet is curved in a direction opposite to the surface of the cylindrical support drum, moreover, the sheet and the support drum do not readily adhere to each other. In the case of thick paper, there is an essential problem arising from the fact that the adhesion of the paper to the support drum is poor because thick paper is highly rigid by nature even in the absence of the aforementioned plastic deformation. For this reason, the sheet is supported by the support drum in a corrugated condition, for example, and even when an image is formed on the sheet, it may be shifted from a predetermined position.

In the case of electrophotography where a toner image is transferred from a photosensitive drum, the pressure between the photosensitive drum and a sheet becomes ununiform and a defective image transfer occurs. Further, there is the possibility of letting the sheet wind about the photosensitive drum instead of a support drum, thus leaving the sheet unpeeled.

As disclosed in Japanese Patent Laid-Open No. 27608/1993, proposed is a paper feeding apparatus for an image forming apparatus with a curl correcting unit for correcting the curvature of a sheet passed between registration rolls. The curl correcting unit is provided with a pair of curl rolls, one of which is made of soft material. The curl roll made of the soft material is largely deformed when both curl rolls are forced to contact each other. When the sheet having the curvature directed opposite to the surface of a cylindrical support drum and fed from the registration rolls is passed between both curl rolls, the sheet, the direction of the curvature of the sheet becomes identical with a tangent on the surface of the support drum.

With the curl correcting unit, however, the curvature radius of the sheet becomes too small, that is, the curvature of the sheet becomes too large and the sheet may not accurately be conveyed to the support drum. Therefore, the sheet is not supported at a predetermined position on the support drum and an image on the whole may be shifted from a desired position.

Since the whole sheet greatly curves, its leading end portion comes in contact with the support drum at almost right angles and may injure the support drum or scrape away a large amount of residual toner on the surface of the support drum, thus conspicuously soiling itself therewith. In this case, the residual toner on the support drum is what has been transferred from the photosensitive drum.

Moreover, the sheet thus greatly curved needs to be conveyed to a fixing device after an image is formed on the sheet supported by the support drum. However, it is not easy to convey such a curved sheet without disturbing the unfixed toner or necessitated to install a great deal of accessory equipment. Even if the sheet passed through the fixing step is discharged its curvature in the form of plastic deformation may be left intact. In this case, the user will have to do the troublesome work of, for example, rolling the sheet in the opposite direction.

SUMMARY OF THE INVENTION

In view of the foregoing problems, an object of the present invention is to provide an image forming apparatus capable of increasing the curvature radius of a sheet that has been curved once. In order to solve the problems above, an image forming apparatus according to the present invention comprises:

- movable sheet support means for supporting a sheet, which sheet support means having an arcuate portion curving outward;
- imaging means for forming an image on the sheet on the sheet support means;
- conveyer means for conveying the sheet to the arcuate portion after curving the sheet outward like the arcuate portion of the sheet support means; and
- correcting means for correcting the curvature radius of the sheet on its way to the sheet support means from the conveyer means so that the curvature radius of the sheet becomes equal to or greater than that of the arcuate portion before guiding the sheet to the arcuate portion.

Therefore, the curvature radius of the sheet curved once by the conveyer means can be increased by the correcting means.

In this case, the conveyer means has a pair of curl rolls for curving the sheet by holding the sheet therebetween and the correcting means has a guide face placed between the curl rolls and the sheet support means and when the leading end portion of the sheet conveyed from the curl rolls abuts and slides on the guide face, a moment is given to the following portion of the sheet held between the curl rolls, whereby the curvature radius of the following portion thereof is corrected.

Thus the correcting means can be extremely be simplified without exerting any dynamic action to the sheet because the curvature radius of the following portion of the sheet is corrected while the sheet itself held between the curl rolls is conveyed.

The guide face is provided with an upstream portion for letting the sheet have a curvature radius substantially equal to the curvature radius of the arcuate portion of the sheet support means on the upstream side of the sheet in the direction in which the sheet is conveyed.

While the leading end portion of the sheet is abutting and sliding on the guide face, the following portion of the sheet also slides on the upstream portion. At this time, the curvature radius of the following portion of the sheet considerably approximates to the curvature radius of the upstream portion of the guide face, that is, that of the arcuate portion of the sheet support means, so that the sheet is allowed to readily stick to the arcuate portion.

A paper guide face is placed opposite to the guide face of the correcting means in the vicinity of the imaging means, and the sheet support means is made movable to and from the imaging means. The imaging means is adapted for use in forming an image on the sheet on the sheet support means when the sheet support means is located close to the imaging means. The correcting means is movable with the movement of the sheet support means and when the sheet support means is situated close to the imaging means, the correcting means is preferably so positioned as to correct the sheet in the vicinity of the paper guide face, whereas when the sheet support means is separated from the imaging means, the correcting means is preferably so positioned as to be separated from the paper guide face.

In this case, the imaging means forms an image on the sheet on the sheet support means when the sheet support means is situated close to the imaging means, and the correcting means is so positioned as to correct the sheet in the vicinity of the paper guide face. When the section between the imaging means and the sheet support means is clogged with the sheet for some reason, the sheet support means is separated from the imaging means. As the sheet support means moves, the correcting means moves so as to be separated from the paper guide face at this time. Thus both the sheet support means and the correcting means are separated from the imaging means and the paper guide face, so that the sheet blocking that section is easily removed.

Further, the downstream portion of the guide face of the correcting means is formed with an elastic member, which is preferably pressed against the paper guide face placed opposite to the guide face of the correcting means.

With this arrangement, the leading end portion of the sheet is passed between the elastic member and the paper guide face and the following portion thereof is subsequently passed between the elastic member and the paper guide face likewise, whereby even slight oscillation of the sheet is suppressed. Even if the sheet bears plastic deformation, it will be corrected at this stage. This arrangement is especially effective for a thin sheet easily liable to producing oscillation.

The above and other objects and features of the present invention will be more apparent from the following description taken in conjunction with the accompanying drawings.

DETAILED DESCRIPTION OF THE PREFERRED EMBODIMENTS

An embodiment of the present invention will subsequently be described with reference to the accompanying drawings.

A. Constitution of the Embodiment of the Invention

A-1. General construction of an image forming apparatus embodying the present invention.

Figure 1:
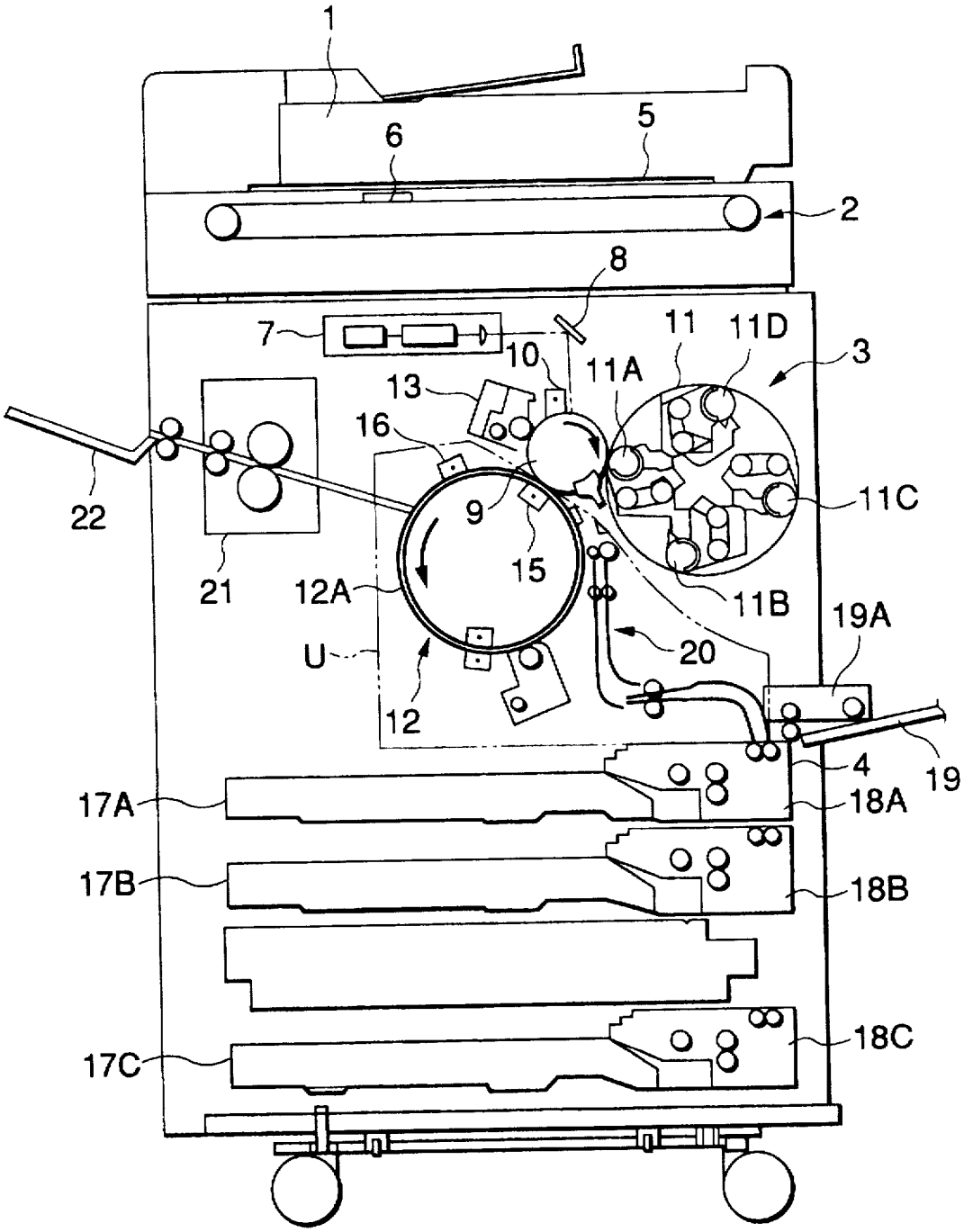
FIG. 1 is an elevational view showing the overall construction of an electrostatic color copying machine as an image forming apparatus embodying the present invention.

FIG. 1 is an elevational view showing the general construction of an electrostatic color copying machine as an image forming apparatus embodying the present invention. This electrostatic color copying machine comprises an image input unit 1, an image forming unit 3 and a paper feeding apparatus 4, and more particularly shown, for example, as 17A, 17B, 17C or 19.

The image input unit 1 has a platen glass 5, a sensor 6 for reading an image on an original and a conveyer belt 2 for conveying the sensor 6. While being conveyed by the conveyer belt 2, the sensor 6 reads an image on the underside of the original loaded on the platen glass 5.

The image forming unit 3 has a photosensitive drum (imaging means) 9, a charged corotron 10 disposed round the photosensitive drum, an exposure device 7, a developing unit 1, a transfer drum (sheet support means) 12, a transfer corotron 15, a cleaner 13 and so forth. The photosensitive drum 9 is driven to rotate in the direction of an arrow in FIG. 1. The charging corotron 10 electrically charges the surface of the rotatable photosensitive drum (imaging means) 9 uniformly. The exposure device 7 emits a laser beam corresponding to the image transferred by the image input unit 1 and the laser beam is reflected from a mirror 8 before being directed to the surface of the charged photosensitive drum 9, whereby a latent image is formed.

The developing unit 11 is a rotary drum having four developing devices 11A, 11B, 11C, 11D. The developing devices 11A, 11B, 11C, 11D each supplies toners of black, yellow, magenta and cyan to the photosensitive drum 9. One of the developing devices 11A, 11B, 11C, 11D supplies the toner to the photosensitive drum 9 each time it turns once, thus causing one color of toner to adhere to the latent image at a time. Then toner images are successively stacked on a sheet sticking to the transfer drum 12, so that a color toner image is formed on the sheet.

The transfer drum 12 is arranged so as to support a roll film 12A between two disklike supports and driven to rotate in the direction of an arrow as it abuts on the photosensitive drum 9. A sheet is conveyed by the paper feeding apparatus and a conveyer unit (conveyer means) 20, which will be described later, to the transfer drum 12 and the sheet is attached to and supported by the transfer drum 12. Further, the sheet is passed through the nip between the photosensitive drum 9 and the transfer drum 12 as the latter rotates.

In the transfer drum 12, the transfer corotron 15 is rigidly placed. The transfer corotron 15 is situated opposite to the nip and when the sheet is passed through the nip, the toner image formed on the photosensitive drum 9 is attracted to the sheet by the electric field generated by the transfer corotron 15 and transferred thereto.

As will described later, the transfer corotron 15 plays the role of making the sheet adhere to the transfer drum 12.

After the toner image has thus been transferred, the surface of the photosensitive drum 9 is cleaned by a cleaner 13 having a cleaning blade. A peeling corotron 16 is placed near the transfer drum 12 and subjects the sheet loaded with the toner image to an electric field in the direction in which the sheet is peeled off the transfer drum 12, so that the sheet is peeled off the transfer drum 12.

A heat-fixing device 21 is placed to the left of the transfer drum 12 in FIG. 1. The sheet peeled off by the peeling corotron 16 is conveyed to the heat-fixing device 21, where the sheet is heated and pressed, whereby the toner image on the sheet is fixed. Then the sheet is discharged onto a feeder output tray 22.

A-2. Construction of conveyer unit.

Figure 2:
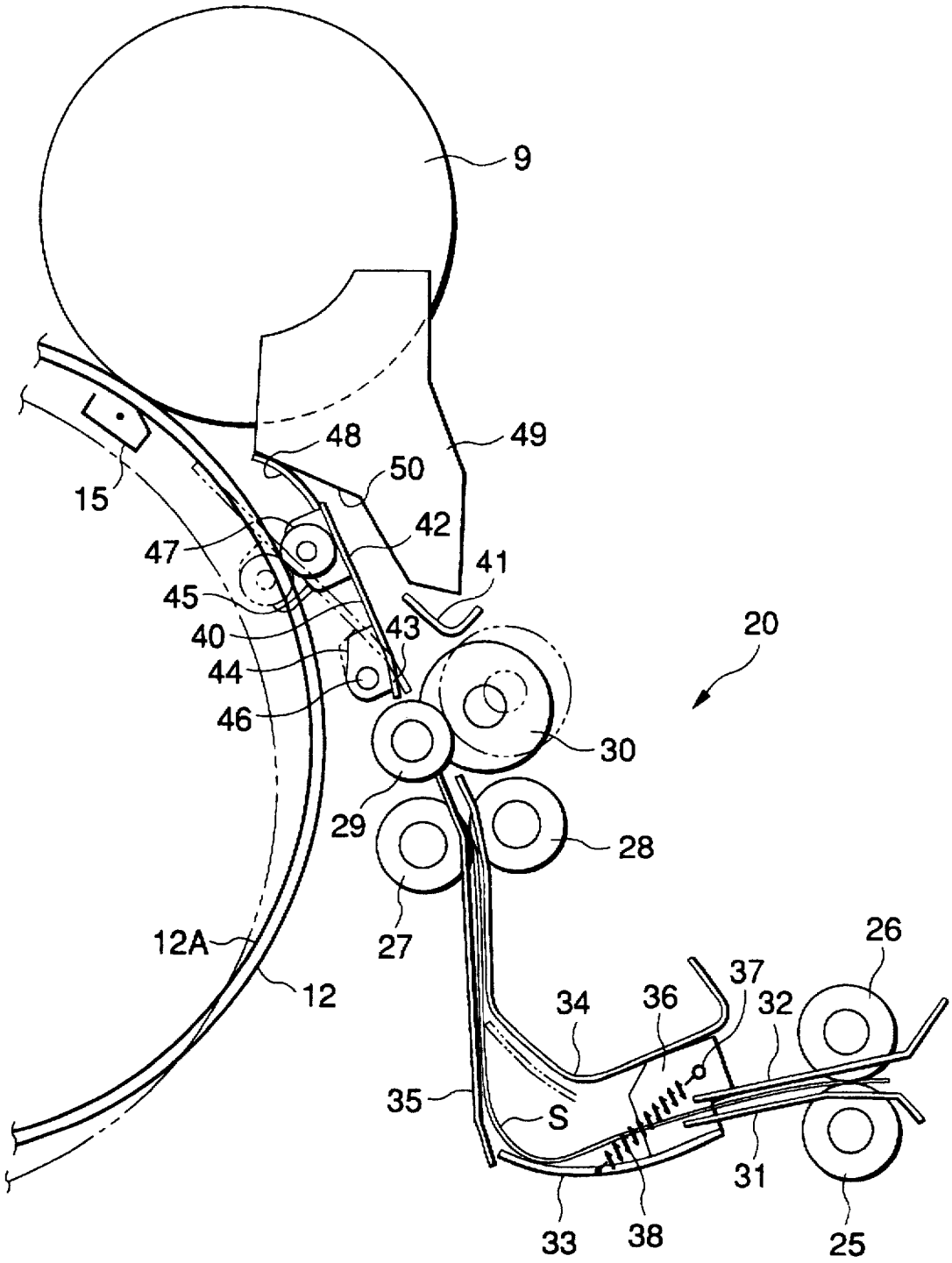
FIG. 2 is an elevational view of the enlarged principal part of the embodiment of the present invention.

Referring to FIG. 2, a description will be given of the construction of the conveyer unit 20.

The conveyer unit 20 has preregistration rolls 25, 26, registration rolls 27, 28 and curl rolls 29, 30 in pairs, respectively. These rolls are rotated so as to convey a sheet S held therebetween. In this case, the preregistration rolls 25, the registration roll 27 and the curl roll 29 are driving rolls, whereas the preregistration roll 26, the registration roll 28 and the curl roll 30 are driven rolls which are driven by the corresponding counterparts.

Guide plates 31, 32 are arranged in parallel to each other near the preregistration rolls 25, 26 and while being passed between the guide plates 31, 32, the sheet S supplied by the paper feeding apparatus 4 is conveyed by the preregistration rolls 25, 26.

Between the guide plates 31, 32 and the registration rolls 27, 28, there are disposed a curved guide plate 34 and two guide plates 33, 35 in substantially parallel to the guide plate 34. The sheet S supplied with driven force by the preregistration rolls 25, 26 is passed between the guide plates 33, 34 and then reaches the registration rolls 27, 28.

When the leading end portion of the sheet S reaches the registration rolls 27, 28, the registration rolls 27, 28 have been stopped from being driven, whereby the leading end portion of the sheet S is also stopped once. However, the preregistration rolls 25, 26 are kept rotating during that time, so that the whole leading edge portion of the sheet S is set uniformly perpendicular to the direction in which the sheet S is conveyed. Simultaneously, the following portion of the sheet S is largely curved.

The guide plate 33 is provided with an overhanging portion 36, which is fitted to the cabinet of the apparatus in a manner rotatable round a pin 37. Further, the guide plate 33 is urged by a coil spring 38 so that it is positioned as shown by an imaginary line of FIG. 2 and when the following portion of the sheet S curves, it is made to turn to the position shown by a continuous line against the force of the coil spring 38.

Thus the rotation of the registration rolls 27, 28 is started at preset timing in conformity with the timing at which the toner image is transferred from the photosensitive drum 9 after the whole leading edge portion of the sheet S is set uniformly perpendicular to the direction in which the sheet S is conveyed and then the sheet S is conveyed toward the curl rolls 29, 30.

The curl roll 29 is made of metal, hard resin or the like, whereas the curl roll 30 is made of soft rubber, sponge or the like. In other words, the curl roll 30 is made of material far softer than what forms the curl roll 29. The curl roll 30 is movable between the position shown by a continuous line and the position shown by an imaginary line and is also held at both the positions.

Whether the curl roll 30 is held at one or the other position above is determined by the user who selects one of the thick and ordinary paper modes through the control panel of a copying machine. In this case, a mechanism (not shown) operates to hold the curl roll 30 at the position shown by the continuous line when the thick paper mode is selected and holds it at the position shown by the imaginary line when the ordinary paper mode is selected. For example, it is preferred to classify the sheet S in two categories: thick paper if it weighs 105 g/cm$^2$; and ordinary paper if it weighs less than that.

Otherwise, a sensor for measuring the weight or thickness of the sheet S may be provided for paper feeding mechanisms 18A, 18B, 18C, 19A or the guide plate 31 so as to determine the position of the curl roll 30 by judging whether the sheet S is thick or thin.

While the curl roll 30 is held at the position shown by the imaginary line, the curl rolls 29, 30 are made to contact the sheet S moderately to the extent at least needed to convey the sheet S. Therefore, the curl rolls 29, 30 apply only weak force to the sheet S (i.e., a thin sheet) caused to pass between the curl rolls 29, 30 thus positioned, so that the sheet S remains uncurved.

When the curl roll 30 is held at the position shown by the continuous line, on the other hand, the curl rolls 29, 30 are strongly forced to contact each other and because of the difference in material therebetween as described above, the curl roll 30 is greatly deformed as far as its part kept in contact with the curl roll 29 is concerned. In other words, the deformation of that part of the curl roll 30 matches the contour of the curl roll 29. Consequently, the sheet S (i.e., a thick sheet) passed between the curl rolls 29, 30 thus positioned is subjected by the curl rolls 29, 30 to great bending force and also largely curved to form a curvature radius in substantially agreement with the contour of the curl roll 29.

A-3. Construction of correcting means.

A guide plate (correcting means) 40 and an opposite guide plate 41, and an upper chute 49 are disposed between the curl rolls 29, 30 and the transfer drum 12. As will be described later, the guide plate 40 is used to guide the thick sheet S, whereas the guide plate 41 and the upper chute 49 are used to guide the thin sheet S. Further, a guide face (paper guiding face) 50 opposing the surface of the transfer drum 12 is formed in the lower portion of the upper chute 49.

The guide plate 40 which is made of metal, hard resin or the like is placed substantially along the direction in which the sheet S is conveyed. Further, overhanging portions 44, 45 are formed on the guide plate 40 on the downstream and upstream sides of the sheet S in the direction in which the sheet S is conveyed. These overhanging portions 44, 45 are overhung toward the transfer drum 12 and the overhanging portion 44 is fitted to the cabinet of the apparatus in a manner rotatable round a pin 46. Further, a tracking roll 47 is rotatably fitted to the overhanging portion 45.

The transfer drum 12 is made movable between the position shown by the continuous line and the position shown by the imaginary line of FIG. 2. When the sheet S is blocked between the photosensitive drum 9 and the transfer drum 12 or when it is blocked in the conveyer unit 20, it is arranged so as to be separated from the photosensitive drum 9 as shown by the imaginary line; in cases other than this one, the transfer drum 12 is set adjacent to the photosensitive drum 9 and held at this position as shown by the continuous line. When the toner image is transferred from the photosensitive drum 9 to the sheet S on the transfer drum 12, the transfer drum 12 is naturally held at the position shown by the continuous line.

As shown in FIG. 1, the transfer drum 12, the conveyer unit 20 and the like are loaded on one unit U and while the transfer drum 12 is separated from the photosensitive drum 9 as shown by the imaginary line, the unit U is made detachable from the image forming apparatus along the vertical direction of the surface of paper of FIG. 1.

When the transfer drum 12 is so positioned that it is separated from the photosensitive drum 9 as shown by the imaginary line, a mechanism (not shown) makes the guide plate 40 stay at the position shown by the imaginary line. When the transfer drum 12 is positioned near the photosensitive drum 9 as shown by the continuous line, the tracking roll 47 abuts on the transfer drum 12 and is rotated toward the photosensitive drum 9, whereby it is held at the position near the guide face 50. In this case, the tracking roll 47 abuts on not the film 12A on the transfer drum 12 but on both hard support portions for supporting the film 12A.

Figure 3:
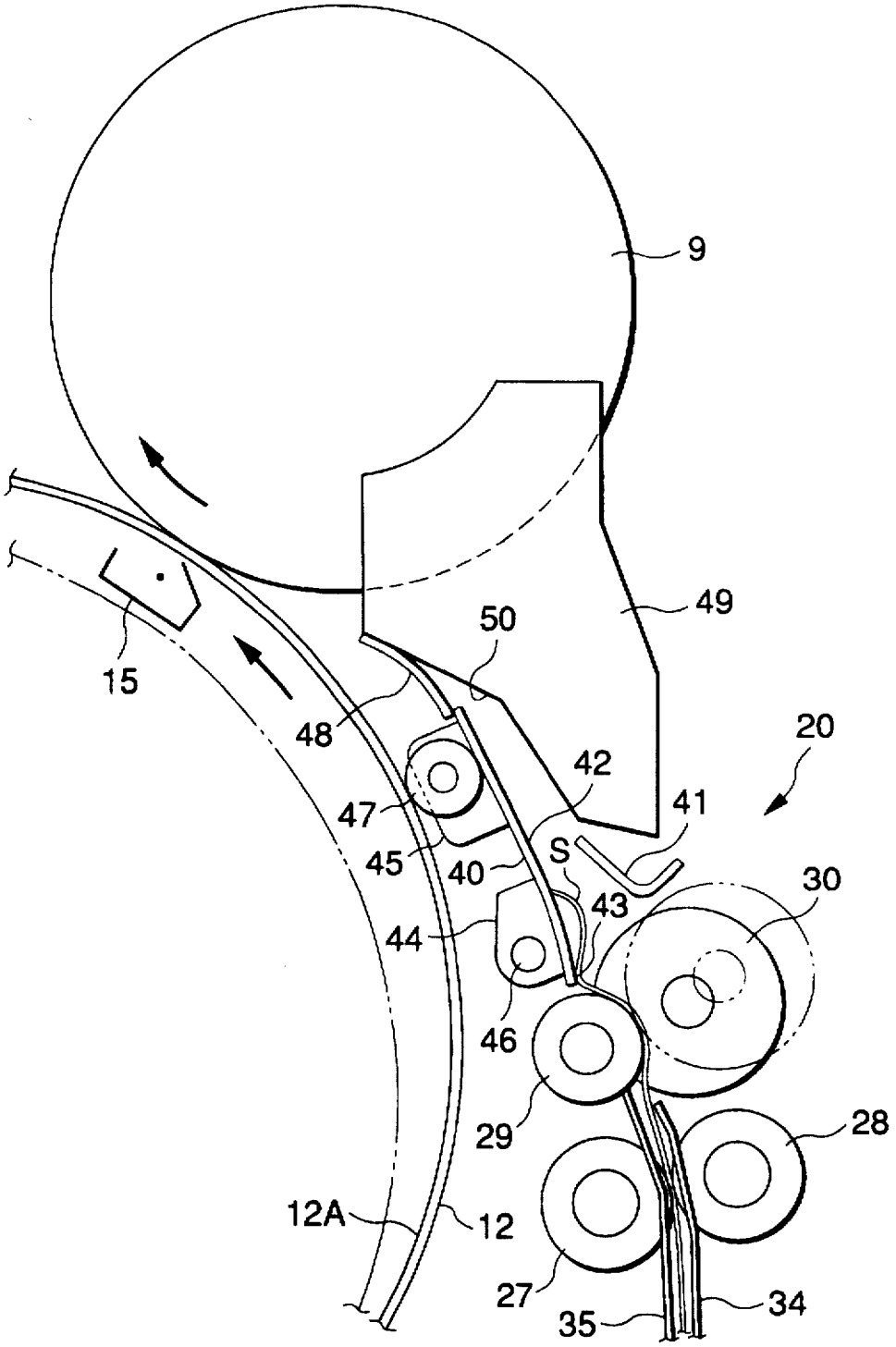
FIG. 3 is an elevational view of a state in which the leading end portion of a sheet is passed between curl rolls and abuts on a guide plate as a correcting means when an image is formed on a thick sheet according to the embodiment of the invention.

Moreover, the guide plate 40 has a smooth guide face 42 on which the sheet S passed between the curl rolls 29, 30 abuts. The guide face 42 is planar on the downstream side of the sheet S in the direction in which the sheet S is conveyed. On the other hand, the upstream portion 43 of guide face 42 on the upstream side is slightly curved with a curvature radius equal to or slightly smaller than that of the transfer drum 12. The angle between the line extended from the upstream portion 43 and the downstream tangent of the rotating curl roll 29 in FIG. 2 is 60°–90° and therefore the sheet S passed between the curl rolls 29, 30 is sharply bent upward as shown in FIG. 3.

Further, a platelike elastic member 48 is firmly secured to the downstream end portion of the guide plate 40. The elastic member 48 is made of soft resin or the like.

B. Operation of the Copying Machine.

B-1. Conveyance of thick sheet and image formation.

The operation of the copying machine thus constructed will subsequently be described. First, while being passed between the guide plates 31, 32, the sheet S supplied by the paper feeding apparatus 4 is conveyed by the preregistration rolls 25, 26.

The sheet S supplied with driven force by the preregistration rolls 25, 26 is passed between the guide plates 33, 34 as well as the guide plates 34, 35 and then reaches the registration rolls 27, 28.

When the leading end portion of the sheet S reaches the registration rolls 27, 28, the registration rolls 27, 28 have already been stopped from being driven, whereby the leading end portion of the sheet S is stopped once. However, the preregistration rolls 25, 26 are kept rotating during that time, so that the leading edge portion of the sheet S is set uniformly perpendicular to the direction in which the sheet S is conveyed. While turning the guide plate 33 from the position shown by the imaginary line up to what is shown by the continuous line, the following portion of the sheet S largely curves. The direction in which the sheet S is curved then is opposite to the surface of the transfer drum 12. When the thick sheet S is curved like this, it is subjected to plastic deformation.

The rotation of the registration rolls 27, 28 is started at predetermined timing after the leading edge portion of the sheet S is set uniformly perpendicular to the direction in which the sheet S is conveyed and the sheet S is conveyed toward the curl rolls 29, 30.

When the thick sheet S is conveyed, the curl roll 30 is held at the position shown by the continuous line as described above. While the sheet S is passed between the curl rolls 29, 30, it is subjected to bending force and sharply bent so as to conform to the curvature radius along the contour of the curl roll 29. Thus the sheet S that has curved in a direction opposite to the surface of the transfer drum 12 due to plastic deformation as described above is conversely caused to curve toward the surface of the transfer drum 12 this time and subjected to plastic deformation in this state.

The leading end portion of the sheet S that has slipped from between the curl rolls 29, 30 then abuts against the upstream portion 43 of the guide face 42 of the guide plate 40. As described above, since the angle between the line extended from the upstream portion 43 and the downstream tangent of the rotating curl roll 29 in FIG. 2 is 60°–90°, the sheet S passed between the curl rolls 29, 30 is sharply bent upward as shown in FIG. 3. However, the thick sheet S has elasticity though it is rigid and more liable to plastic deformation than the thin sheet, so that the leading end portion of the sheet S deflects in the direction in which it has been curved by the curl rolls 29, 30 and comes in contact with the guide face 42.

Figure 4:
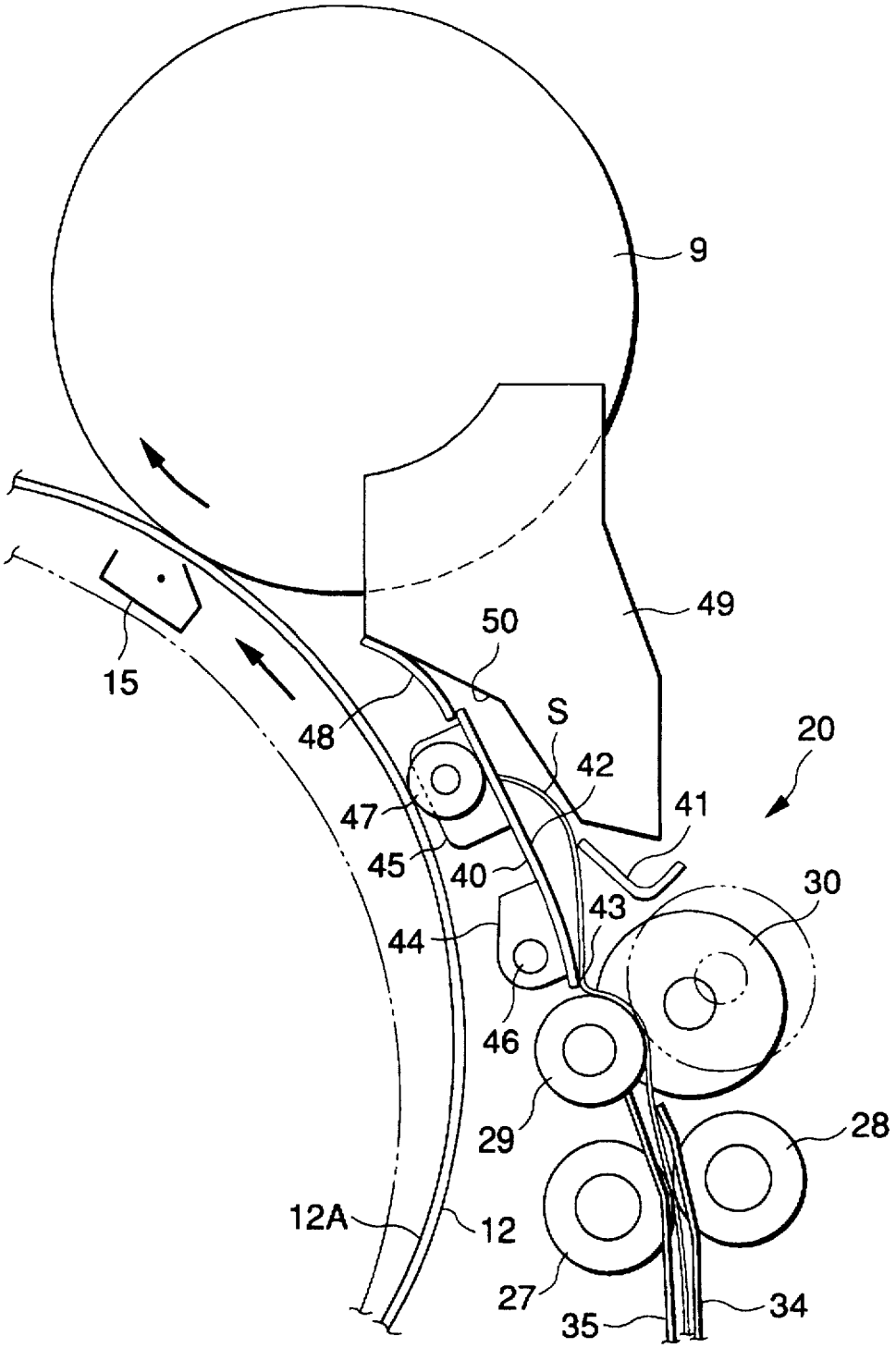
FIG. 4 is an elevational view of a process which follows FIG. 3.

As the sheet S moves onward, its leading end portion abuts and slides on the guide face 42 as shown in FIGS. 2 through 4. The guide face 42 is planar on the downstream side of the sheet S in the direction in which the sheet S is conveyed and while the leading end portion of the sheet S is passing thereon, the sheet S that has been curved once by the curl rolls 29, 30 is gradually elongated, so that the curvature radius of the sheet S grows larger.

When the leading end portion of the sheet S abuts and slides on the guide face 42 in that case, the leading end portion thereof receives the counterforce directed from the guide face 42 to the upper right direction of FIG. 4. Further, the sheet S with the following portion held between the curl rolls 29, 30 is assumed to be a cantilever and the bending moment caused by the counterforce is produced between the leading end portion of the sheet S and that following portion held between the curl rolls 29, 30. The moment becomes greater in the following portion of the sheet S as its following portion is separated from the position where the counterforce is applied. Therefore, the following portion of the sheet S is more elongated.

While the leading end portion of the sheet S is thus abutting and sliding on the guide face 42, its following portion slides on the upstream portion 43 of the guide face 42. Therefore, the curvature radius of the following portion of the sheet S becomes equal to or greater than the curvature radius of the upstream portion 43, that is, the curvature radius of the transfer drum 12.

Figure 5:
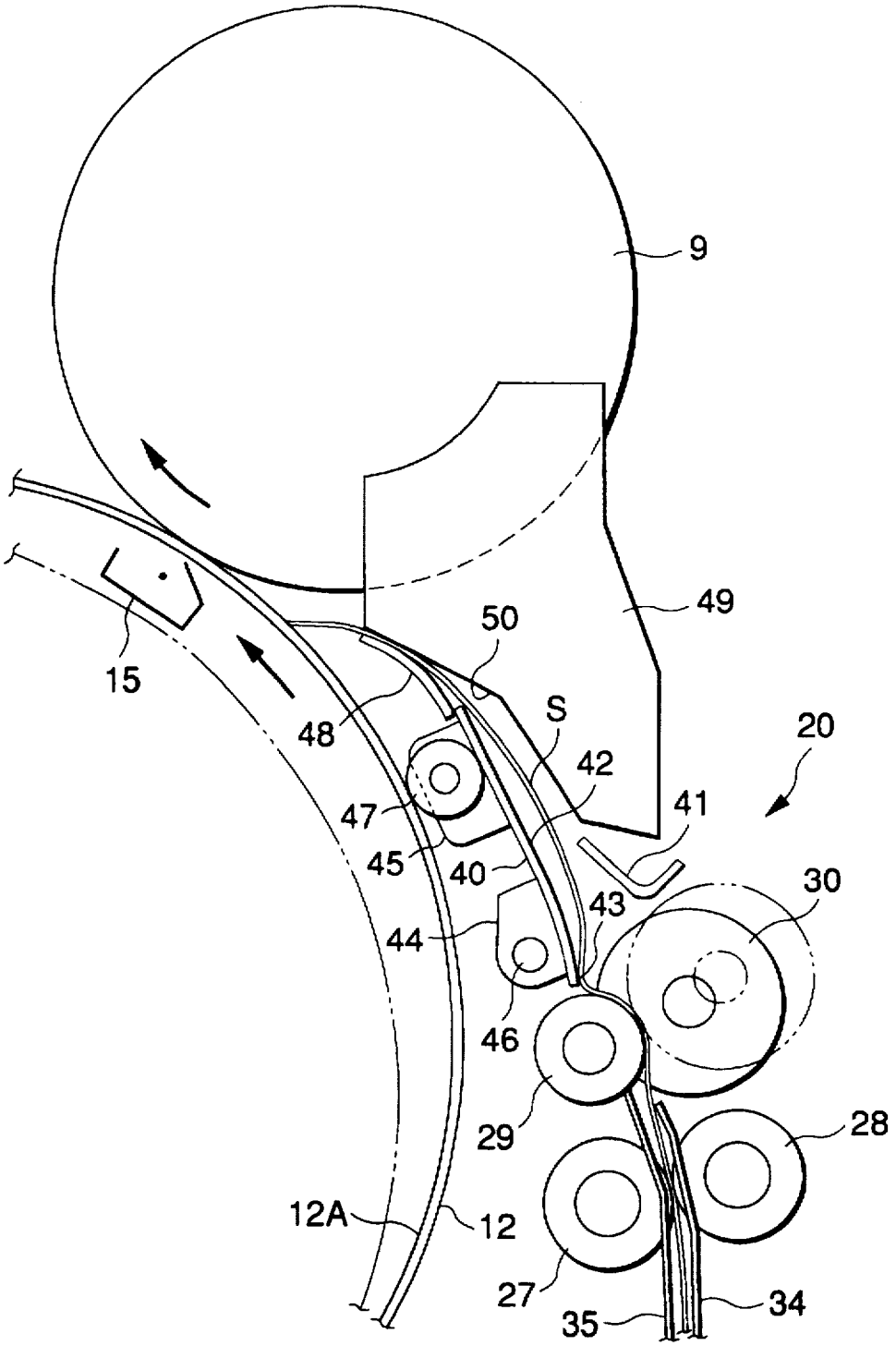
FIG. 5 is an elevational view of a process which follows FIG. 4.

Further, the leading end portion of the sheet S slides on the elastic member 48 and passes thereon and then reaches the transfer drum 12 as shown in FIG. 5. At this point of time, the transfer drum 12 has started rotating in the direction of an arrow and the leading end portion of the sheet S is kept moving while in contact with the transfer drum 12 at a speed equal to that of the surface of the transfer drum 12.

Moreover, a bias voltage is applied to the transfer corotron 15 so that an electric field for attracting the sheet S is generated. Although the voltage level then is set lower than the voltage level at the time the toner image on the photosensitive drum 9 is attracted, it is still set high enough to have the sheet S attracted to the transfer drum 12.

Then the sheet S is made to adhere to the transfer drum 12 by the electric field generated by the transfer corotron 15 when the sheet S is moving while in contact with the transfer drum 12 passes close to the transfer corotron 15.

Subsequently, the rotation of the photosensitive drum 9 is started and in the meantime the toner image is formed on the surface of the photosensitive drum 9 by the developing unit 11; even during this time, the transfer drum 12 is kept rotating.

Figure 6:
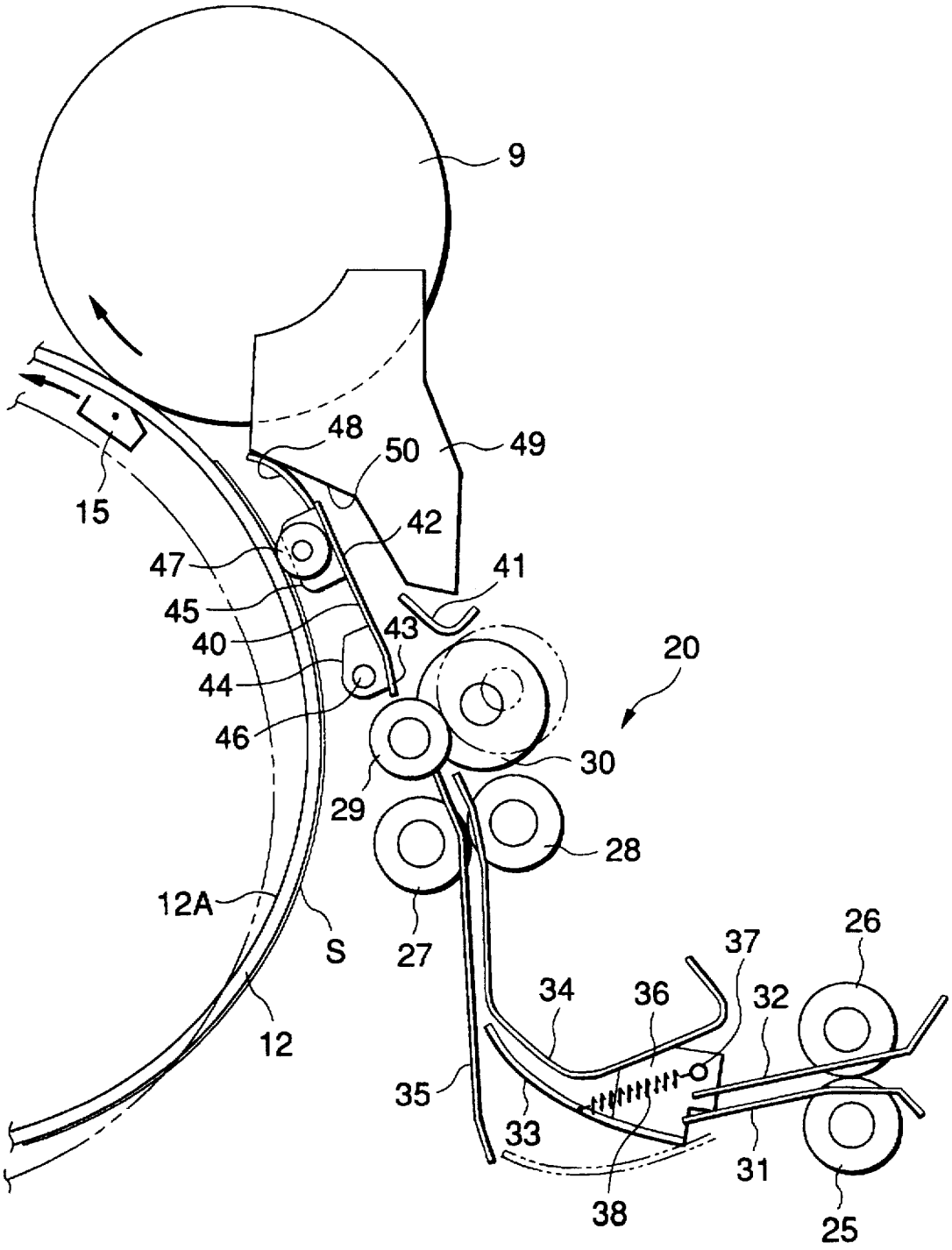
FIG. 6 is an elevational view of a process which follows FIG. 5.

As shown in FIG. 6, further, the transfer drum 12 is moved close to the photosensitive drum 9 and a bias voltage is applied by the transfer corotron 15 to generate an electric field for attracting the toner on the photosensitive drum 9 to the transfer drum 12. While the sheet S is passed through the nip between the transfer drum 12 and the photosensitive drum 9 as the transfer drum 12 rotates, the toner image is transferred onto the sheet S because of the action of the electric field generated by the transfer corotron 15.

When an image is formed on the thick sheet S, the toner image is thus transferred from the photosensitive drum 9 onto the sheet S after the sheet S has completely stuck onto the transfer drum 12.

Then the sheet S is conveyed to the heat-fixing device 21 where it is heated and pressurized, so that the toner image is fixed onto the sheet S.

B-2. Conveyance of thin sheet and image formation.

A description will subsequently be described of the ordinary paper mode, that is, a case where the thin sheet S is conveyed so as to form an image thereon.

In the ordinary paper mode, the sheet S supplied with driven force by the preregistration rolls 25, 26 and passed between the guide plates 33, 34 as well as the guide plates 34, 35 reaches the registration rolls 27, 28.

Then the leading end portion of the sheet S is stopped once by the registration rolls 27, 28 that have been brought to a standstill and the rotation of the preregistration rolls 25, 26 makes the leading edge portion of the sheet S uniformly perpendicular to the direction in which the sheet S is conveyed during this time. While turning the guide plate 33 from the position shown by the imaginary line up to what is shown by the continuous line, the following portion of the sheet S largely curves. The direction in which the sheet S curves is directed opposite to the surface of the transfer drum 12. However, the thin sheet S is less subjected to plastic deformation because it is less rigid and hardly liable to plastic deformation.

The rotation of the registration rolls 27, 28 is started at the predetermined timing after the leading edge portion of the sheet S is set uniformly perpendicular to the direction in which the sheet S is conveyed, whereby the sheet S is conveyed to the curl rolls 29, 30.

Figure 7:
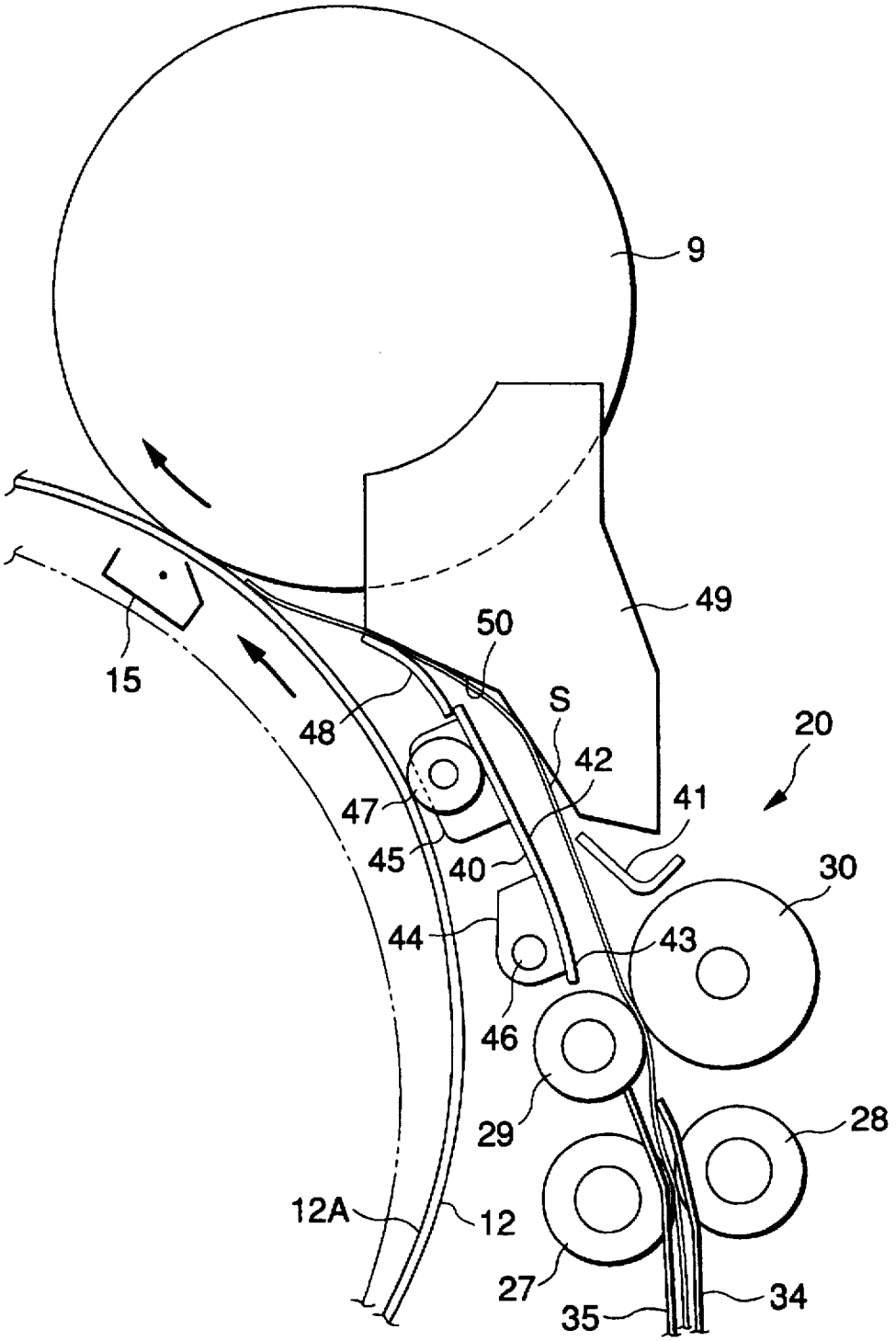
FIG. 7 is an elevational view of a process when an image is formed on a thin sheet according to the embodiment of the invention.

When the thin sheet S is conveyed, the curl roll 30 is held at the position shown in FIG. 7 (the position shown by the imaginary line of FIG. 2 and so forth). While the sheet S is passing between the curl rolls 29, 30, the sheet S is substantially subjected to no bending force. As described above, this is due to the fact that as the plastic deformation of the sheet S is small when the leading end portion of the sheet S is stopped and curved by the registration rolls 27, 28, the plastic deformation needs no correcting.

Therefore, the sheet S is not largely curved nor corrugated by the curl rolls 29, 30.

The leading end portion of the sheet S passed between the curl rolls 29, 30 is guided by the guide plates 40, 41 and abuts on the guide face 50 of the upper chute 49. As described above, the transfer drum 12 has been placed close to the photosensitive drum 9 and consequently the guide plate 40 is also turned to the side of the guide face 50. Therefore, the leading end portion of the elastic member 48 at the tip end of the guide plate 40 is made to contact the guide face 50 of the upper chute 49. The leading end portion of the sheet S slides along the guide face 50 and passes between the elastic member 48 and the guide face 50, whereas the following portion subsequently passes between the elastic member 48 and the guide face 50 likewise. Thus the sheet S is suppressed from producing even slight oscillation. Even if the plastic deformation of the sheet S occurs when the leading end portion of the sheet S is stopped and curved by the registration rolls 27, 28, the deformation will be corrected at this stage.

Although this process of correction is similar to the case of the thick sheet S (see FIG. 5), it is especially effective for the thin sheet S because the thin sheet S is liable to produce oscillation.

Then the leading end portion of the sheet S reaches the transfer drum 12. At this point of time, the transfer drum 12 has started rotating in the direction of an arrow and the leading end portion of the sheet S is kept in contact with the transfer drum 12 and moving at a speed equal to that of the surface of the transfer drum 12.

Moreover, the bias voltage is applied to the transfer corotron 15 so that the electric field generated thereby attracts the toner on the photosensitive drum 9.

At this point of time, the color toner image has been formed on the surface of the photosensitive drum 9 and while the sheet S on the transfer drum 12 is passed through the nip between the transfer drum 12 and the photosensitive drum 9, the electric field of the transfer corotron 15 acts so that the toner image may be transferred onto the sheet S.

When an image is formed on the thin sheet S, the toner image is transferred from the photosensitive drum 9 onto the sheet S in a short time after the sheet S comes in contact with the transfer drum 12.

Then the sheet S is conveyed to the heat-fixing device 21 where it is heated and pressurized, whereby the toner image is fixed to the sheet S.

C. Effect of the Embodiment of the Invention.

As set forth above, according to this embodiment of the invention, the curvature radius of the thick sheet S that has been curved once by the curl rolls 29, 30 of the conveyer unit 20 can be made smaller.

Therefore, such a thick sheet S can accurately be conveyed to the transfer drum 12, whereby the image is prevented from shifting from the desired position on the whole because the sheet S is made to precisely stick to the predetermined position on the transfer drum 12.

Since the curving of the sheet is suppressed, its leading end portion is prevented from coming in contact with the transfer drum 12 at a substantially right angle. Therefore, the surface of the transfer drum 12 is restrained from being damaged and the leading end portion of the sheet S is made substantially free from being stained with the residual toner on the surface of the transfer drum 12, which stain would be made if the leading end portion of the sheet S is led to scrap off the residual toner.

Further, no large curvature is left to the sheet S discharged after an image is formed thereon, which makes it unnecessary for the user to do the work of correcting the curvature of the sheet S.

Moreover, the curvature radius of the following portion of the sheet S which is conveyed while being held between the curl rolls 29, 30 is corrected by making the leading end portion of the sheet S abut on the guide face 42 of the guide plate 40. Therefore, the construction of the apparatus can be extremely simplified because no dynamic action is needed to exert on the sheet S. Consequently, the apparatus is almost free from trouble and economical because the number of parts is unincreased.

While the leading end portion of the sheet S is abutting and sliding on the guide face 42, the following portion of the sheet S slides on the upstream portion 43 having the curvature radius substantially equal to that of the transfer drum 12. Therefore, the curvature radius of the following portion of the sheet S considerably approximates to the transfer drum 12, so that the sheet is allowed to readily stick to the arcuate portion. Thus the pressure between the photosensitive drum 9 and the sheet S is uniformized with the effect of eliminating a defective image transfer.

When the section between the photosensitive drum 9 and the transfer drum 12 is clogged with the sheet S for some reason, the transfer drum 12 can be separated from the photosensitive drum 9. As the transfer drum 12 moves, the guide plate 40 moves so as to be separated from photosensitive drum 9 at this time. Thus both the transfer drum 12 and the guide plate 40 are separated from the photosensitive drum 9, so that the sheet blocking that section is easily removed.

When an image is formed on the thick sheet S according to this embodiment of the invention, the toner image is transferred from the photosensitive drum 9 onto the sheet S after the sheet S has completely stuck onto the transfer drum 12. This means that the toner image is transferred from the photosensitive drum 9 onto the sheet S after the sheet S has completely passed between the curl rolls 29, 30. Since the sheet S is held between the curl rolls 29, 30 with strong force, an impact is given to the sheet S when it slips out of the nip therebetween and the impact is transmitted via the sheet S to the transfer drum 12, thus causing its rotational speed to fluctuate. However, the transfer operation remains unaffected by the impact because no toner image transfer is carried out then.

Moreover, the voltage level of the transfer corotron 15 when the sheet S is made to stick to the transfer drum 12 should be lower than the voltage level when the toner image is transferred so as not to impede the toner image transfer. However, the toner image is transferred after the thick sheet S has completely stuck to the transfer drum 12 according to this embodiment of the invention. Consequently, it is possible to raise the voltage level of the transfer corotron 15 to a certain extent when the sheet S is stuck to the transfer drum 12 because the potential on the surface of the transfer drum 12 slightly lowers with the elapse of time.

According to this embodiment of the invention, moreover, the toner image is transferred from the photosensitive drum 9 onto the sheet S in a short time after the sheet S comes in contact with the transfer drum 12 when an image is formed on the thin sheet S, whereby the efficiency of processing image formation on the thin sheet is not lowered.

Further, the sheet S is not largely curved nor corrugated by the curl rolls 29, 30 when the thin sheet S is conveyed. The sheet S is passed through a very small gap between the elastic member 48 and the guide face 50. Thus the sheet S is suppressed from producing even slight oscillation. Even if the plastic deformation of the sheet S occurs when the leading end portion of the sheet S is stopped and curved by the registration rolls 27, 28, the deformation is corrected at this stage. Therefore, the sheet is allowed to readily stick to the arcuate portion and the pressure between the photosensitive drum 9 and the sheet S is uniformized with the effect of eliminating a defective image transfer.

D. Modified Example

The present invention is not limited to the aforementioned embodiment but may be modified in various manners.

(1) Although the aforementioned embodiment of the invention has been described with reference to an electrostatic copying machine for transferring a toner image from the photosensitive drum 9 to the sheet S, it is applicable to ink-jet printers and any other image forming apparatus as long as the sheet S is supported by a sheet support means having an arcuate portion curving outward.

(2) A bias transfer roll to which bias voltage is directly applied, in place of the transfer drum 12, may be used as the sheet support means.

(EXAMPLE)

An example corresponding the image forming apparatus according to the above embodiment of the invention was made. In this case, a metal curl roll 29 having a diameter of 12 mm was formed, whereas a curl roll 30 having an outer diameter of 26 mm was made by covering a metal shaft having a diameter of 12 mm with sponge rubber having a hardness of 10° (resulting from measurement by applying a load of 300 gf using a sponge rubber hardness meter of Ascar C type of Kobunshi Kagakusha). The curl roll 30 was made to bite into the curl roll 29 by 2.7 mm in the thick paper mode. A transfer drum 12 having a radius of 84 mm was used.

In this case, the curvature of a thick sheet S immediately after it has passed between the curl rolls 29, 30 ranges from $1/80$ to $1/100$ and approximated close in value to $1/84$ which was the curvature of the transfer drum 12. The leading end portion of the sheet S passed through the nip between the curl rolls 29, 30 was allowed to run freely by about 20 mm. When the leading end portion of the sheet S reached the downstream side of a guide plate 40, the curvature of the sheet S became lowest, ranging from $1/150$ to $1/200$, and even when the sheet S was caused to proceed further, the value was also found in the range above. Thus the effect of correcting the curvature of the guide plate 40 was confirmed.

As set forth above, the curvature radius of the sheet which has been curved once can be increased in the image forming apparatus according to the present invention.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus, comprising:

rotatable sheet support means having an arcuate portion curving outward for supporting a sheet;

imaging means for forming an image on said sheet on said sheet support means;

conveyer means for conveying said sheet to said arcuate portion after curving said sheet outward like said arcuate portion of said sheet support means; and correcting means for correcting the curvature radius of said sheet on its way to said sheet support means from said conveyer means so that the curvature radius of said sheet becomes equal to or greater than that of said arcuate portion before guiding said sheet to said arcuate portion.

2. An image forming apparatus as claimed in claim 1, wherein said conveyer means has a pair of curl rolls for curving said sheet by holding said sheet therebetween, and wherein said correcting means has a guide face placed between said curl rolls and said sheet support means and when the leading end portion of said sheet conveyed from said curl rolls abuts and slides on said guide face, a moment is given to the following portion of said sheet held between said curl rolls, whereby the curvature radius of said following portion thereof is corrected.

3. An image forming apparatus as claimed in claim 2, wherein said guide face has an upstream portion for letting said sheet have a curvature radius substantially equal to the curvature radius of said arcuate portion of said sheet support means on the upstream side of said sheet in the direction in which said sheet is conveyed.

4. An image forming apparatus as claimed in claim 2, wherein a paper guide face is placed opposite to the guide face of said correcting means in the vicinity of said imaging means; said sheet support means is made movable to and from said imaging means; said imaging means is adapted for use in forming an image on said sheet on said sheet support means when said sheet support means is located close to said imaging means; and said correcting means is movable with the movement of said sheet support means and when said sheet support means is situated close to said imaging means, said correcting means is so positioned as to correct said sheet in the vicinity of said paper guide face, whereas when said sheet support means is separated from said imaging means, said correcting means is so positioned as to be separated from said paper guide face.

5. An image forming apparatus as claimed in claim 2, wherein the downstream portion of the guide face of said correcting means is formed with an elastic member, which is pressed against the paper guide face placed opposite to the guide face of said correcting means.

6. An image forming apparatus having a sheet correcting unit for correcting a curvature of a sheet, comprising:

a photosensitive drum;

a movable transfer drum, the movable transfer drum having an arcuate portion supporting the sheet, the movable transfer drum being movable in and between a substantial contact position with the photosensitive drum and a non-contact position with the photosensitive drum, wherein a tangential line is formed along a line of contact between the photosensitive drum and the movable transfer drum when the movable transfer drum is in the substantial contact position;

a conveyer unit conveying the sheet to the movable transfer drum and disposed adjacent to the transfer drum, the conveyer unit forming a curve in the sheet; and a guide plate disposed adjacent to the conveyor unit, the guide plate guiding the curved sheet so that a leading portion of the sheet is substantially parallel to the tangential line as the sheet is guided to the transfer drum.

7. The apparatus of claim 6, wherein the conveyer unit includes a pair of adjacent curl rolls for curving the sheet, and wherein the guide plate includes a guide face positioned between the curl rolls and the transfer drum, the guide face having an upper portion, the upper portion creating a radius in the curved sheet that is substantially equal to or greater than a radius of the arcuate portion of the transfer drum.

8. The apparatus of claim 7, wherein a leading portion of the sheet is conveyed from the curl rolls and slides on the guide face so that a moment is generated in a downstream portion of the sheet held between the curl rolls thereby correcting a curve of the following portion of the sheet.

9. An image forming apparatus having a sheet correcting unit for correcting a curvature of a sheet, comprising:

a photosensitive drum;

a movable transfer drum, the movable transfer drum having an arcuate portion for supporting the sheet, the movable transfer drum being movable in and between a substantial contact position with the photosensitive drum and a non-contact position with the photosensitive drum, wherein a tangential line is formed between the photosensitive drum and the movable transfer drum when the movable transfer drum is in the substantial contact position;

a conveyer unit conveying the sheet to the movable transfer drum and disposed adjacent to the transfer drum, the conveyer unit having a pair of curl rolls that curve the sheet; and a guide plate disposed adjacent to the photosensitive drum, the guide plate having a guide face positioned substantially between the curl rolls and the transfer drum, the guide face correcting the curve of the sheet so that a leading portion of the sheet is substantially parallel to the tangential line.

10. The apparatus of claim 9, wherein the guide face includes an upper portion that creates a radius in the curved sheet that is equal to or greater than a radius of the arcuate portion of the transfer drum.

* * * * *